US007476078B2

(12) United States Patent
Doebbeling et al.

(10) Patent No.: US 7,476,078 B2
(45) Date of Patent: Jan. 13, 2009

(54) ROTOR WITH CORE SURROUNDED BY SHIELDING RINGS

(75) Inventors: Klaus Doebbeling, Windisch (CH); Joachim Krautzig, Widen (CH)

(73) Assignee: Alstom Technology Ltd, Baden (CH)

( * ) Notice: Subject to any disclaimer, the term of this patent is extended or adjusted under 35 U.S.C. 154(b) by 503 days.

(21) Appl. No.: 11/056,367

(22) Filed: Feb. 14, 2005

(65) Prior Publication Data

US 2005/0180847 A1 Aug. 18, 2005
US 2006/0269403 A9 Nov. 30, 2006

(30) Foreign Application Priority Data

Feb. 14, 2004 (DE) ..... 10 2004 007 327

(51) Int. Cl.
*F01D 5/08* (2006.01)

(52) U.S. Cl. ..... 415/115; 415/175; 415/176; 415/178; 415/216.1; 416/95; 416/96 R; 416/198 A; 416/215; 416/241 R; 416/244 A

(58) Field of Classification Search ..... 416/198 A, 416/200 A, 201 R, 95, 96 R, 215–218, 241 R, 416/244 A; 415/115, 175–178, 216.1
See application file for complete search history.

(56) References Cited

U.S. PATENT DOCUMENTS 2,656,147 A * 10/1953 Brownhill et al. ..... 416/198 A
3,894,324 A * 7/1975 Holzapfel et al. ..... 416/198 A
4,910,958 A * 3/1990 Kreitmeier ..... 416/95
5,414,929 A * 5/1995 Floser et al. ..... 416/198 R
5,842,831 A 12/1998 Galke et al.
6,416,276 B1 7/2002 Marmilic et al.

FOREIGN PATENT DOCUMENTS

DE 971 297 1/1959
DE 1122551 A * 1/1962 ..... 416/215
DE 42 39 710 A 1 6/1994
DE 196 13 472 A 1 10/1997
GB 543985 A * 3/1942 ..... 416/198 A
GB 574752 A * 1/1946 ..... 416/198 A

* cited by examiner

*Primary Examiner*—Christopher Verdier
(74) *Attorney, Agent, or Firm*—Buchanan Ingersoll & Rooney PC

(57) ABSTRACT

A rotor of a thermally loaded turbomachine, in particular of a compressor or a gas turbine, is mounted such that it can rotate about a rotor axis and is concentrically surrounded by a hot-gas duct or cooling-air duct. A significant improvement to the ability of the rotor to withstand thermal loads is achieved, with little increased outlay in terms of materials, by virtue of the fact that the rotor comprises a rotor core made of a first material, that the rotor core is concentrically surrounded by shielding rings made of a second material, which shield the rotor core from the temperature in the hot-gas duct or cooling-air duct, the second material having a higher heat resistance than the first material, and that the shielding rings are cohesively joined to the rotor core.

9 Claims, 3 Drawing Sheets

ROTOR WITH CORE SURROUNDED BY SHIELDING RINGS

FIELD OF THE INVENTION

The present invention deals with the field of rotors.

DISCUSSION OF BACKGROUND

On account of the lower materials costs, the improved welding properties and ultrasound testing properties and on account of the more favorable fracture mechanics properties, rotors for use at high temperatures in gas or steam turbines are preferably made of ferritic steels. However, the mechanical properties of ferritic steels deteriorate so greatly above 450° C. that it becomes necessary to use austenitic steels.

The rotor, which in gas turbines is located below the hot-gas duct, has long being shielded by separate blades and heat shields made of high-temperature materials. However, this shielding has a highly segmented structure, and the individual elements are only secured to the rotor by various types of hooks. If a ferritic material is used for the rotor, relatively large quantities of cooling air at most 450° C. are required to purge the spaces between the rotor and the shielding elements.

Compressors, even if they have outlet temperatures of more than approximately 450° C., have hitherto generally been designed without any shielding and cooling, since shielding alone provides only a little protection against excessively high peak loads, while cooling with recycling of cooling air into the compressor duct has an adverse effect on efficiency.

Nevertheless, the use of heat shields to shield the rotor from the hot-gas duct has also been proposed for compressors (cf. U.S. Pat. Nos. 5,842,831 and 6,416,276B1). In the case of these known shields, the heat shields are secured to the rotor in a positively locking manner. They therefore have the same drawbacks as those which have already been cited above in connection with the gas turbines with a segmented shielding arrangement.

SUMMARY OF THE INVENTION

Accordingly, it is an object of the invention to provide a rotor for operation at elevated temperatures which avoids the drawbacks of known rotors and in particular allows the use of a relatively inexpensive material for the rotor without having to make significant concessions as to the operating temperature and the efficiency of the machine.

The core idea of the invention consists in manufacturing a rotor core from a first, inexpensive material, which is unable to satisfy the requirements imposed with regard to the higher temperatures in the hot-gas duct or cooling-air duct, and then concentrically surrounding the rotor core with shielding rings made of a second material, which shield the rotor core from the higher temperature in the hot-gas duct or cooling-air duct, with the second material having a higher heat resistance than the first material. The shielding rings are in this case cohesively joined to the rotor core.

It is preferable for the first material to be a ferritic steel and the second material to be an austenitic steel.

It has proven particularly suitable for the shielding rings to be joined to the rotor core by soldering or welding.

The shielding action can be further improved if cooling ducts for cooling air to flow through are additionally provided on the inner side of the shielding rings.

Depending on the position within the rotor, the shielding rings may be designed exclusively to shield the rotor core, and may each have a flat rectangular or wedge-shaped cross section, or, if they are shielding the rotor core from the high temperatures in the hot-gas duct, they may be designed to receive rotor blades. However, they may also each have a cross-sectional profile in the form of a double T shape, in order to achieve greater radial flexibility and thermal insulation.

BRIEF DESCRIPTION OF THE DRAWINGS

The invention is be explained in more detail below on the basis of exemplary embodiments and in conjunction with the drawings.

DETAILED DESCRIPTION

Figure 1:
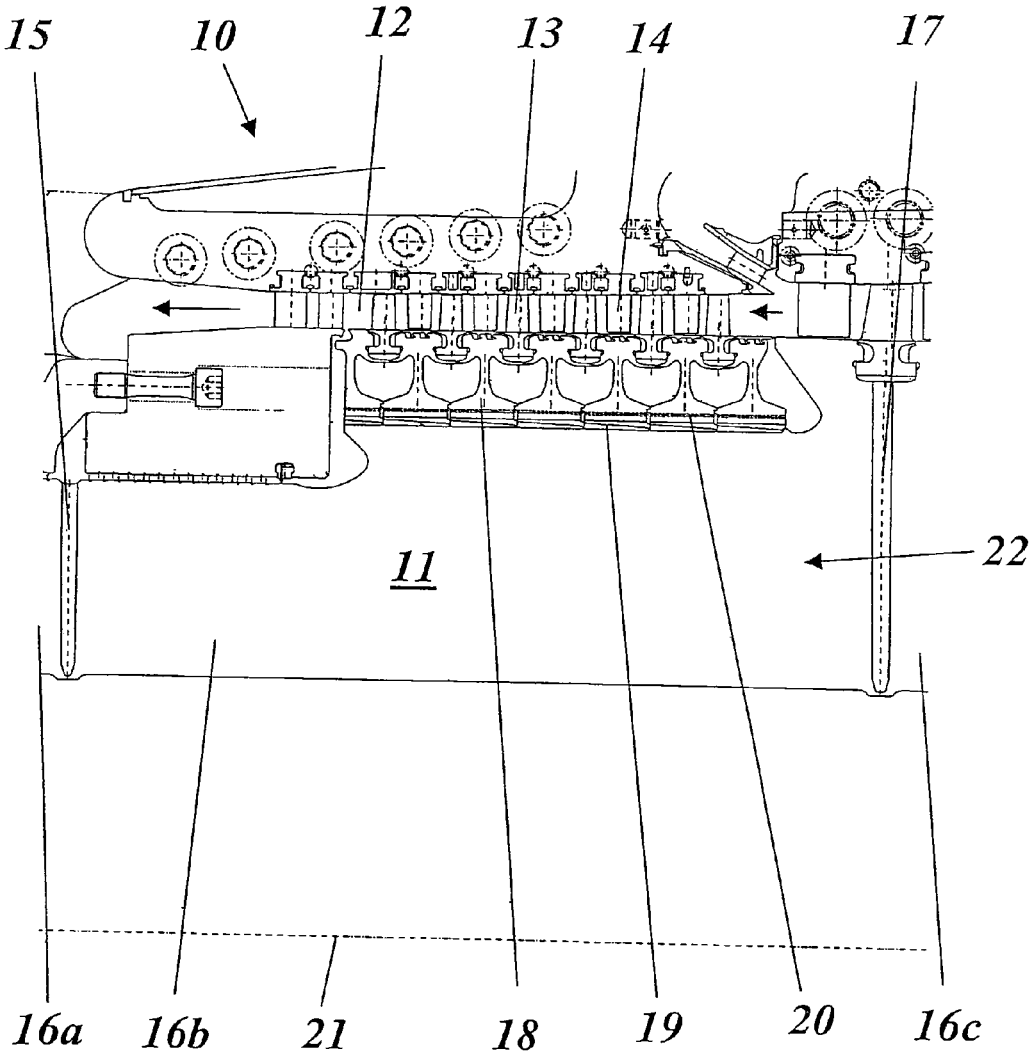
FIG. 1 is a sectional view of a rotor constructed according to the present invention.

The figure reproduces an excerpt from a rotor 11 of a compressor 10 in longitudinal section. The compressor 10 is part of a gas turbine. The excerpt comprises the high-pressure and output stages of the multistage compressor 10. The rotor 11 is mounted inside the compressor 10 in such a manner that it can rotate about a rotor axis 21. The rotor 11 comprises a plurality of rotor rings 16*a*, 16*b*, 16*c* which are arranged one behind the other in the axial direction and are joined to one another by weld seams 15, 17. The rotor 11 is concentrically surrounded by a hot-gas duct 12, through which the compressed gas (air) flows in the direction of the arrows shown in the drawing.

In the hot-gas duct 12, rotor blades 13 and guide vanes 14 are arranged in succession in alternating rows in the axial direction. The guide vanes 14 are fitted to the housing surrounding the hot-gas duct 12. The rotor blades 13 are secured into the rotor 11 and rotate with the rotor 11 about the rotor axis 21.

The middle rotor ring 16*b*, in which the high-pressure and output stages of the compressor 10 are to be found, and which accordingly is exposed to the highest temperatures in the hot-gas duct 12 (or in the cooling-air duct), is composed of two different materials: the main constituent is a solid, central rotor core 22 made of a ferritic steel. A plurality of shielding rings 18 made of austenitic steel with a double T-shaped cross-sectional profile are pushed onto this rotor core in succession in the axial direction and are welded to the rotor core 22 at the ring inner surface (welded joint 19). In another exemplary embodiment, they are soldered in place. Between adjacent shielding rings 18, cutouts which serve to receive and hold the rotor blades 13 are provided on the outer circumference. Cavities are located between the shielding rings 18 below the rotor blades 13. The T-shaped foot region of the shielding rings 18 means that additional cooling ducts 20 run in the axial direction just above the welded joints 19, further improving the thermal decoupling between rotor core 22 and hot-gas duct 12 or cooling-air duct.

The present invention improves the thermal load-bearing capacity of the rotor 11 without the rotor having to be produced completely from an austenitic material. Arranging the shielding rings 18 made of austenitic material between the hot-gas duct 13 of the compressor or the cooling-air duct of the turbine and the rotor core 22 made of ferritic material allows the temperatures at the compressor outlet or of the cooling air in the cooling-air duct to be raised by approximately 100° C. At the same time, only a small quantity of cooling air at a lower temperature is required to cool the inner side of the shielding rings 18 (by means of the cooling ducts 20). This makes it possible to considerably improve the efficiency without the rotor in its entirety having to be produced from a different material.

Figure 2A:
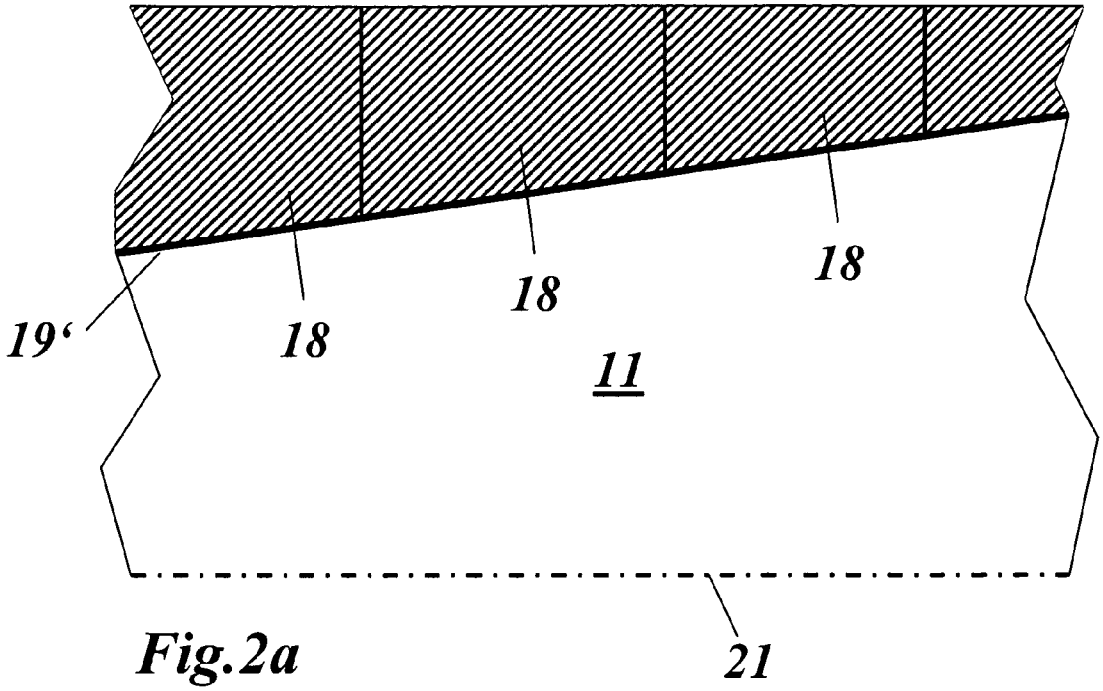
FIG. 2*a*-2*d* are partial sectional views of the rotor constructed according to alternative embodiments of the present invention.
Figure 2B:
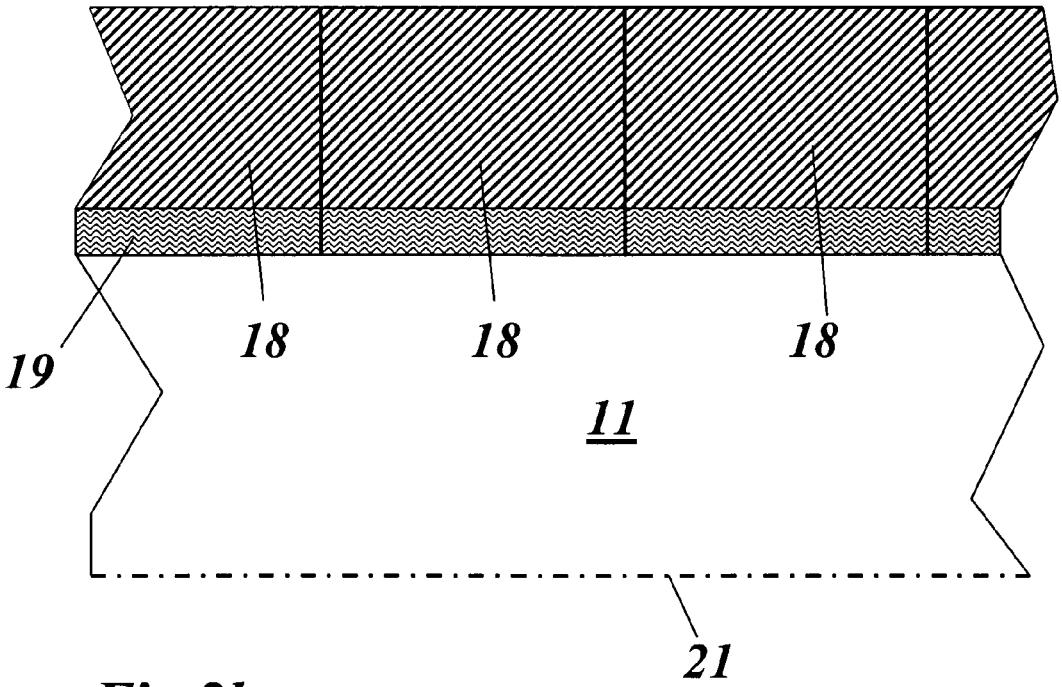
Figure 2C:
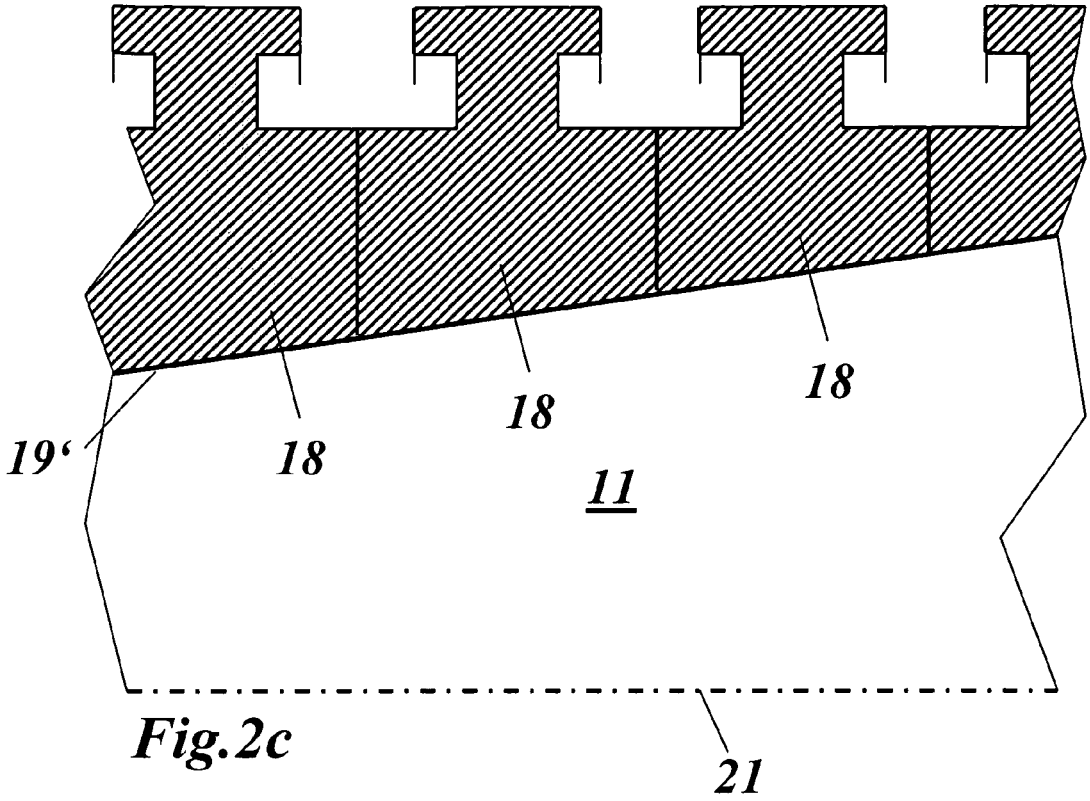
Figure 2D:
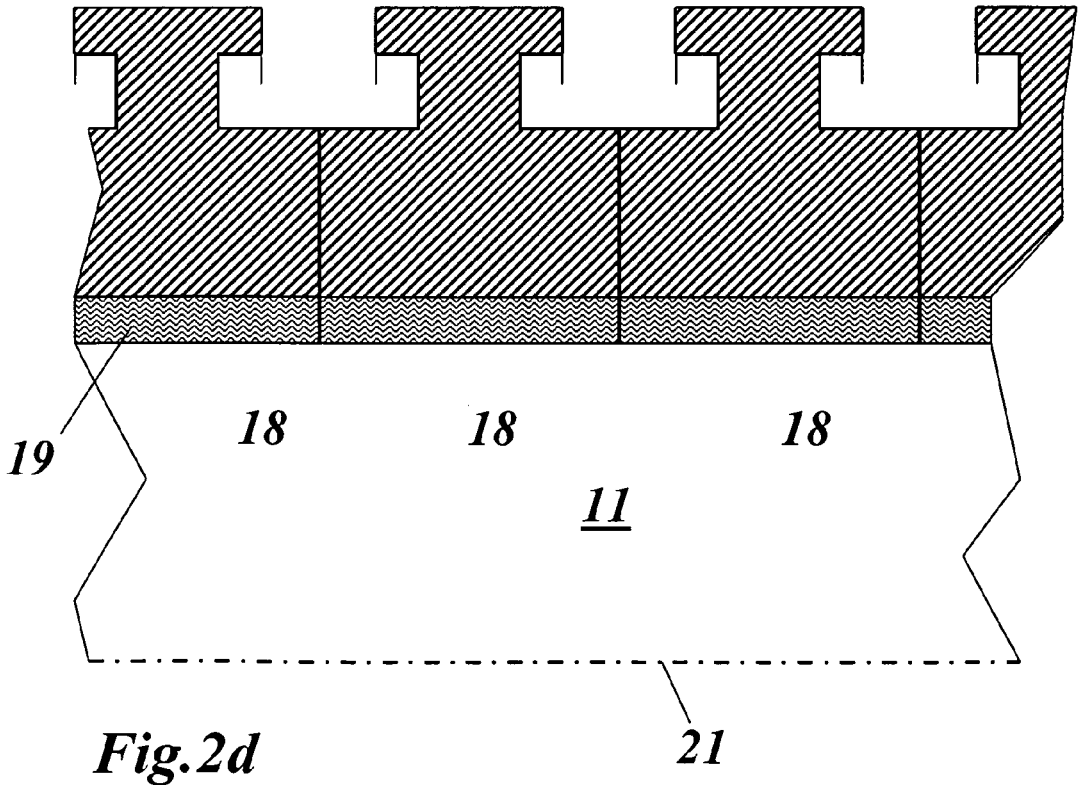

Overall, the present invention proposes a rotor having a rotor core made of ferritic material which is surrounded by relatively thin shielding rings made of austenitic material which are fixedly joined to the rotor core by soldering or welding. The cross section of the shielding rings may differ according to the local requirements: wide and flat rectangular cross sections (FIGS. 2*a*-2*b*) with a cylindrical (FIGS. 2*b*-2*d*) or conical (FIGS. 2*a*-2*c*) outer surface are particularly suitable for purely shielding purposes. Individual rings may be provided with hooks for holding rotor blades. Rings with a double T-shaped profile allow a greater radial flexibility and thermal insulation to be achieved. To protect the ferritic rotor core from excessively high temperatures, it is possible for ducts for a cooling medium to be integrated on the inner circumference of the shielding rings.

The invention claimed is:

1. A rotor of a compressor or a gas turbine, wherein the rotor is mounted such that it can rotate about a rotor axis and is concentrically surrounded by a hot-gas duct or cooling-air duct, the rotor comprises a rotor core made of a first material, the rotor core comprising an outermost periphery having a first diameter, the rotor core is concentrically surrounded without a gap by closed single-piece shielding rings made of a second material, which shield the rotor core from the temperature in the hot-gas duct or cooling-air duct, the second material having a higher heat resistance than the first material, and in that the shielding rings are cohesively joined to the rotor core and the shielding rings having an innermost portion that does not extend radially inward beyond the first diameter.

2. The rotor as claimed in claim 1, wherein the first material is a ferritic steel, and wherein the second material is an austenitic steel.

3. The rotor as claimed in claim 1, wherein the shielding rings are joined to the rotor core by soldering or welding.

4. The rotor as claimed in claim 1, wherein cooling ducts for cooling air to flow through are provided on the inner side of the shielding rings.

5. The rotor as claimed in claim 1, wherein the shielding rings are designed exclusively to shield the rotor core, and wherein the shielding rings each have a flat rectangular or wedge-shaped cross section.

6. The rotor as claimed in claim 1, wherein the shielding rings shield the rotor core from the temperatures in the hot-gas duct, and wherein the shielding rings are designed to receive rotor blades.

7. The rotor as claimed in claim 1, wherein the shielding rings each have a cross-sectional profile in the form of a double T shape.

8. The rotor of claim 1, wherein the shielding rings are axially contiguous.

9. The rotor of claim 1, wherein adjacent shielding rings have cutouts adapted to receive rotor blades therein.

* * * * *